United States Patent [19]

Ross

[11] Patent Number: 4,871,340

[45] Date of Patent: Oct. 3, 1989

[54] MAGNETIC ACTION TOY

[76] Inventor: Bruce Ross, 8 Kiska Ct., Randallstown, Md. 21133

[21] Appl. No.: 255,968

[22] Filed: Oct. 11, 1988

[51] Int. Cl.[4] ..... A63H 33/26

[52] U.S. Cl. ..... 446/132; 446/138

[58] Field of Search ..... 446/138, 137, 135, 134, 446/133, 132, 131, 129; 273/138 A

[56] References Cited

U.S. PATENT DOCUMENTS

| | | | |
|---|---|---|---|
| 2,818,680 | 1/1958 | Borsos | 446/135 |
| 2,994,984 | 8/1961 | Luchsinger | 446/132 |
| 3,097,448 | 6/1963 | Prankard . | |
| 4,531,923 | 9/1985 | Lohr | 446/138 |

OTHER PUBLICATIONS

"Space-Trix", H. Fishlove & Co., Chicago, Ill., Mar. 1965.

*Primary Examiner*—Mickey Yu

[57] ABSTRACT

A hand held magnetic track toy having a rolling permanent magnet or magnets that depend on another permanent magnet for orientation of their magnetic poles and support on a track surface. The magnetic poles of the rolling permanent magnets are aligned in a similar direction and in parallel axes with respect to each other due to the influence of the magnetic poles of the other permanent magnet whereby the rolling permanent magnets are provided with the ability to travel at a high rate of speed on the track surface and perform intriguing bumping movements.

10 Claims, 1 Drawing Sheet

MAGNETIC ACTION TOY

BACKGROUND—FIELD OF INVENTION

This invention relates to magnetic toys, specifically to those which use rotating or rolling magnets on a hand held track.

BACKGROUND—DESCRIPTION OF PRIOR ART

Many consumers enjoy magnets, magnetic toys, and magnetic games simply because of the unique feel of magnetic attraction and the intriguing way in which magnetic fields interact. For this reason, there have been a number of commercially successful magnetic games, toys and amusements.

Heretofore, all such devices that are hand held and depend on a user to initiate and maintain the movement of a rolling magnet or several rolling magnets on a track have been limited to relatively slow movements of said rolling magnets. In fact, slow movement of the rolling magnet or rolling magnets is a requirement in order to successfully operate these devices without having said magnets separate from the track.

No prior art suggests maintaining the orientation and alignment of magnetic poles and physical support of one or more rolling permanent magnets on a hand held track through interaction with the magnetic poles of another permanent magnet.

No prior art suggests using a permanent magnet, means for positioning said permanent magnet behind a track surface, and rolling permanent magnets having each of their magnetic axes aligned with their axis of rotation to produce high velocity movement of said rolling permanent magnets on said track wherein the problem of separation of said permanent rolling magnets from said track or misalignment of the magnetic poles of said rolling magnets is solved.

No prior art has suggested the improved high speed bumping effects wherein one rolling permanent magnet can effectively bump another rolling permanent magnet at high speed without physical contact.

In addition, hand held magnetic track toys which use rolling magnets have required minimal skill to operate and thus have provided little challenge to users.

One type of construction is shown by Lohr in Pat. No. 4,531,923 issued July 30, 1985. This device is comprised of a spinner having two wheels joined by a magnetic axle. Said magnetic axle is attracted to a metal track in the form of a wand. Thus the user can orient the wand so that gravity will start the spinner rotating and by moving the wand maintain the rolling motion. The outer wheels maintain alignment of the spinner on the metal track while the magnetic core supports the spinner through magnetic attraction to the wand. The magnetic axle has a relatively small diameter so that the spinner's normal rate of travel is relatively slow.

Other devices similar to Lohr's use two parallel, metal, wire rails in place of the aforementioned wand. The spinner is usually a single wheel having a magnetic axle, the ends of which are attracted to the parallel wire rails. Said wheel is positioned between said parallel metal wire rails. Operation and performance is similar to Lohr's device; however, alignment is maintained by said parallel metal rails which are attracted to the ends of said magnetic axle.

Another type of construction is shown by Prunkard in Pat. No. 3,097,448 issued July 16, 1963. This device is comprised of a metal tube positioned vertically such that when a disk magnet is placed at the top end of the tube it procedes to spiral down the tube's length due to the forces of gravity and the magnetic attraction of the disk magnet to the metal tube. The magnetic disk used in this way is relatively slow moving and follows a different path each time it is released. Another application of Prunkard's device is to hold the tube horizontally and use up and down motions to cause the magnetic disk to rotate about the tube roughly perpendicular to the centerline of the tube. In this mode the disk speed is limited by the weight of the disk magnet and its relative attraction to the metal tube. Positioning of the magnetic disk on the tube cannot be precisely controlled and ultimately the disk will wander the length of the tube. If several disks were used at once on the tube they would be attracted to one another rather than produce the aforementioned bumping effect.

No prior art constructions teach interaction of the magnetic poles of rolling permanent magnets with the magnetic poles of another permanent magnet for alignment and support purposes. Nor do any of these prior art constructions teach the surprising and entertaining high speed bumping action as taught by the magnetic action toy of this invention. None of the prior art constructions use rolling permanent magnets which provide fast paced action.

Manufacturers and consumers would therefore find it desirable to have a hand held magnetic track toy having a rolling permanent magnet or magnets which uses another permanent magnet for support and alignment purposes on said track to provide fast paced action and surprising, intriguing movements while also requiring some level of skill on the part of the user.

OBJECTS AND ADVANTAGES

Accordingly several objects and advantages of this invention are to provide a hand held magnetic track toy having a rolling permanent magnet or magnets wherein said rolling permanent magnets have their poles aligned in a similar orientation and in relatively parallel axes with respect to each other. This alignment of said rolling permanent magnets is maintained by the attractive force of opposite magnetic poles of said rolling permanent magnets and another permanent magnet. Said attractive force also provides physical support of the rolling permanent magnet or magnets on said track surface.

Another object and advantage is to provide a hand held magnetic track toy having a rolling permanent magnet or magnets wherein said rolling permanent magnets can move rapidly on said track and provide a surprising and entertaining high speed bumping action whereby the magnetic poles of said rolling permanent magnets are aligned so that a rolling permanent magnet can bump another rolling permanent magnet without physical contact because of the repelling action of like magnetic poles.

Another object and advantage is to provide a hand held magnetic track toy having a rolling permanent magnet or magnets that is entertaining challenging and amusing for users of all ages.

Readers will find further objects and advantages of the invention from a consideration of the ensuing description and the accompanying drawings.

DRAWING FIGURES

Figure 1:
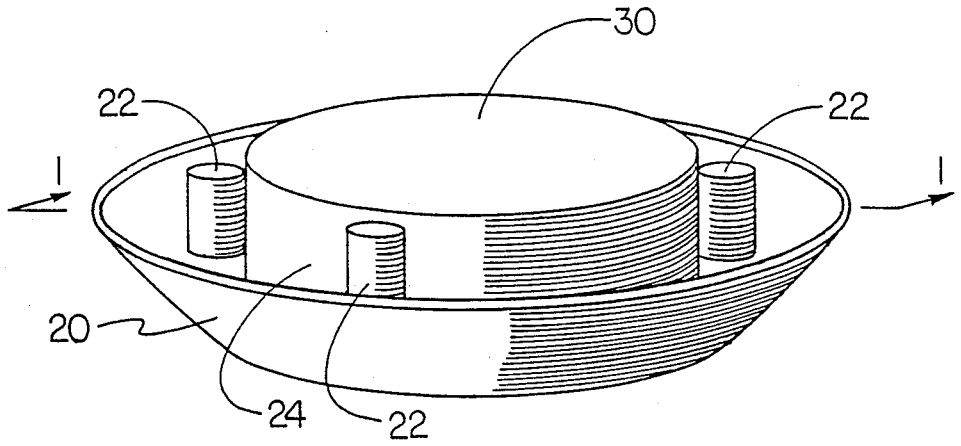
FIG. 1 shows a perspective view of an embodiment of the magnetic action toy according to the invention.

Drawing Reference Numerals 20 bowl
22 rolling permanent magnet
24 track surface
26 permanent ring magnet
28 cover
30 insignia surface

DESCRIPTION

FIG. 1 shows a magnetic action toy according to an embodiment of the invention. This embodiment comprises a bowl 20 having curved magnets for retaining loose magnets maximizing control of play and providing a comfortable holding surface for the palm of one hand, a smooth cylindrically shaped track surface 24 which provides a path for the cylindrically shaped rolling permanent magnet 22 to follow and an insignia surface 30 for decorative purposes. The bowl 20 would be preferably made of a molded plastic.

Figure 2:
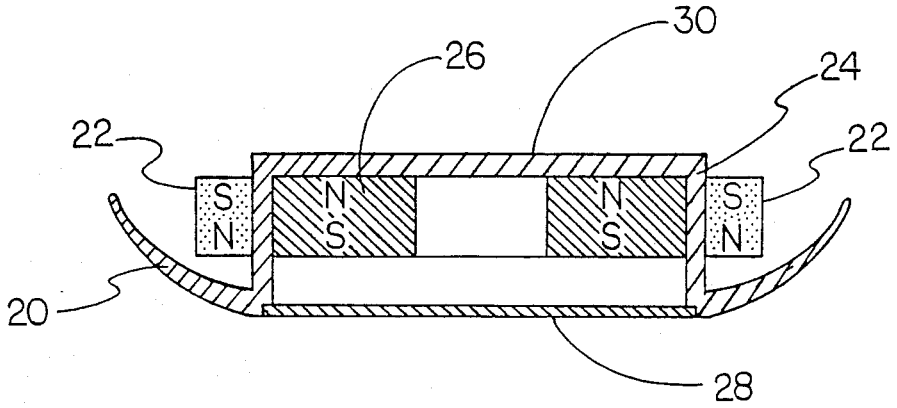
FIG. 2 shows a sectional view of the magnetic action toy of FIG. 1 along section 1—1.

FIG. 2 is a sectional drawing along section line 1—1 of FIG. 1 and shows that a provision in bowl 20 has been made for the permanent ring magnet 26 and cover 28. Also shown in FIG. 2 is the relative alignment of the magnetic poles of said cylindrical rolling permanent magnets 22 with respect to the magnetic poles of the permanent ring magnet 26 wherein "N" and "S" represent the north and south magnetic poles, respectively. In order to ensure maximum operating speed, the axis of rotation of each rolling permanent magnet 22 is in alignment with its respective magnetic axis.

Operation

The magnetic action toy of FIG. 1 can provide an enjoyable play experience throught the mastery of several learned skills and by using one or more rolling magnets 22 on said track surface while performing various hand movements.

When one rolling magnet 22 is placed on the track surface 24 by the user said rolling magnet 22 automatically orient its magnetic poles with the corresponding opposite poles of said permanent ring magnet 26. The attractive force of the opposite magnetic poles also provides needed support to hold said rolling permanent magnet 22 against said track surface 24 and overcome gravitational and mechanical forces acting on said rolling permanent magnet 22.

After placement of the rolling permanent magnet 22 on said track surface 24 the user holds the magnetic action toy of FIG. 1 in a relatively horizontal position in the palm of one hand while moving the device in a circular motion in a relatively horizontal plane. This motion will cause the rolling permanent magnet to begin moving around the track surface 24. With practice the rolling permanent magnet 22 can be made to travel at a relatively high rate of speed so as to become difficult for the eye to distinguish.

When two rolling permanent magnets 22 are placed on the track surface 24 each of these rolling permanent magnets 22 will have its poles oriented in the same direction and in parallel axes with respect to each other due to the influence of the magnetic poles of said permanent ring magnet 26. The similarly oriented magnetic poles of said rolling permanent magnets 22 will keep each of said rolling permanent magnets 22 separated on said track surface 24 due to the repelling action of like magnetic poles.

A user can learn to propel one of the two rolling permanent magnets 22 around the track surface 24 while the other rolling permanent magnet 22 remains relatively stationary on said track surface 24 by using the circular motion technique described previously. When the moving rolling permanent magnet 22 approaches the other non-moving rolling permanent magnet 22 at a high rate of speed the repelling action of the similarly oriented magnetic poles causes the non-moving rolling permanent magnet 22 to be bumped without being physically touched by the approaching rolling permanent magnet 22. Assuming that both of the rolling permanent magnets 22 are relatively the same size and weight then the non-moving rolling permanent magnet 22 is propelled around the track surface 24 after being bumped in this way. The former moving rolling permanent magnet 22 becomes non-moving having given up virtually all of its energy of movement to the formerly non-moving rolling permanent magnet 22. This conservation of momentum occurs in much the same way as when a moving billiard ball directly strikes another stationary billiard ball.

The one moving rolling permanent magnet 22 will procede around the track until it encounters the other non-moving rolling permanent magnet 22 and the process is repeated. The user can sustain this action by continuing to rotate the magnetic action toy in a circular motion. If performed at a rapid rate a surprising sustained illusion is created wherein one rolling permanent magnet 22 appears to pass through another.

Additional rolling permanent magnets 22 can be placed on the track surface 24. Using the aforementioned technique of rotating the magnetic track toy in a circular motion a virtual chain reaction can be initiated wherein one rolling permanent magnet 22 bumps another and that in turn bumps another and so forth.

The foregoing discussion describes the basic operation of the magnetic action toy and several effects which can be obtained. A number of other entertaining and amusing effects can be performed with practice and a healthy imagination insuring many hours of intriguing play.

Conclusion, Ramifications, and Scope of Invention

Thus the reader will see that the magnetic action toy of this invention provides a hand held magnetic track toy with fast paced action, surprising and intriguing bumping movements, and skill development which can be enjoyed by users of all ages. In addition, the device uses rolling permanent magnets whose support on the track surface, magnetic pole alignment, and orientation are provided by the magnetic attraction of another permanent magnet.

While the above description contains many specificities, these should not be construed as limitations on the scope of the invention, but rather as an exemplification of one preferred embodiment thereof. Many other variations are possible. For example skilled artisans will readily be able to change the dimensions and shapes of the various embodiments. Alternative materials may be used. Said bowl may be eliminated. Several permanent ring magnets can be used. Different types and shapes of permanent magnets can be used. Differently shaped tracks can be used. Accordingly, the reader is requested to determine the scope of the invention by the appended claims and their legal equivalents, and not by the examples which have been given.

I claim:

1. A hand held magnetic track toy comprising:

a permanent magnet, a rolling permanent magnet having its axis of rotation in alignment with its magnetic axis, a track surface, whereby a smooth path is provided for said permanent rolling magnet, means for positioning said permanent magnet behind said track surface whereby the magnetic attraction of opposite magnetic poles between said permanent magnet and said rolling permanent magnet provides support for said rolling permanent magnet on said track surface and alignment of the magnetic axis of said rolling permanent magnet relatively parallel to the magnetic axis of said permanent magnet, bowl shaped means having curved inner and outer sides for retaining said loose rolling permanent magnet and providing a comfortably curved holding surface whereby the outer side is curved to fit the palm of one hand to provide for maximum control of play and ease of insertion and removal of said rolling permanent magnet, whereby the rolling permanent magnet is provided with the ability to move at a high rate of speed with respect to the permanent magnet while maintaining its magnetic pole alignment and position on said track surface.

2. The toy of claim 1 wherein said rolling permanent magnet is cylindrically shaped.

3. The toy of claim 1 wherein said permanent magnet is a permanent ring magnet.

4. The toy of claim 3 wherein said track surface is the outer surface of said permanent ring magnet whereby said outer surface of said permanent ring magnet provides a smooth and continuous path for said rolling permanent magnet.

5. The toy of claim 1 wherein said track surface is cylindrically shaped.

6. A hand held magnetic track toy comprising:

a permanent magnet, a plurality of rolling permanent magnets each having its axis of rotation in alignment with its magnetic axis, a track surface, whereby a smooth path is provided for said permanent rolling magnets, means for positioning said permanent magnet behind said track surface whereby the magnetic attraction of opposite magnetic poles between said permanent magnet and said rolling permanent magnets provides support for said rolling permanent magnets on said track surface and alignment of the magnetic axes of said rolling permanent magnets relatively parallel to each other and to the magnetic axis of said permanent magnet, bowl shaped means having curved inner and outer sides for retaining said loose rolling permanent magnets and providing a comfortably curved holding surface whereby the outer side is curved to fit the palm of one hand to provide for maximum control of play and ease of insertion and removal of said rolling permanent magnets, whereby the rolling permanent magnets are provided with the ability to move at a high rate of speed on said track surface with respect to the permanent magnet and perform high speed bumping movements with each other while maintaining their magnetic pole alignment and position on said track surface.

7. The toy of claim 6 wherein said rolling permanent magnets are cylindrically shaped.

8. The toy of claim 6 wherein said permanent magnet is a permanent ring magnet.

9. The toy of claim 8 wherein said track surface is the outer surface of said permanent ring magnet whereby said outer surface of said permanent ring magnet provides a smooth and continuous path for said rolling permanent magnets.

10. The toy of claim 6 wherein said track surface is cylindrically shaped.

* * * * *

UNITED STATES PATENT AND TRADEMARK OFFICE

CERTIFICATE OF CORRECTION

PATENT NO. : 4,871,340

DATED : October 3, 1989

INVENTOR(S) : Bruce Ross

It is certified that error appears in the above-identified patent and that said Letters Patent is hereby corrected as shown below:

Col. 3, line 19, change "magnets" to --sides--.

Col. 3, line 20, after "magnets" insert --,--.

Col. 3, line 47, change "orient" to --orients--.

Signed and Sealed this

Fourteenth Day of August, 1990

*Attest:*

HARRY F. MANBECK, JR.

*Attesting Officer*

*Commissioner of Patents and Trademarks*